US009067218B2

(12) United States Patent
Yu

(10) Patent No.: US 9,067,218 B2
(45) Date of Patent: Jun. 30, 2015

(54) ROTARY SPRAY SHOWER HEAD

(75) Inventor: Zhangjun Yu, Zhangzhou (CN)

(73) Assignee: SINYU TECHNOLOGY (FUJIAN) CO., LTD., Zhangzhou, Fujian (CN)

( * ) Notice: Subject to any disclaimer, the term of this patent is extended or adjusted under 35 U.S.C. 154(b) by 121 days.

(21) Appl. No.: 14/114,739

(22) PCT Filed: May 16, 2011

(86) PCT No.: PCT/CN2011/074072

§ 371 (c)(1),
(2), (4) Date: Oct. 29, 2013

(87) PCT Pub. No.: WO2012/071857

PCT Pub. Date: Jun. 7, 2012

(65) Prior Publication Data

US 2014/0110502 A1 Apr. 24, 2014

(30) Foreign Application Priority Data

Dec. 1, 2010 (CN) ..... 2010 2 0654731 U

(51) Int. Cl.

| | |
|---|---|
| ***B05B 1/18*** | (2006.01) |
| ***B05B 3/04*** | (2006.01) |
| ***B05B 1/16*** | (2006.01) |

(52) U.S. Cl.

CPC ..... *B05B 3/0427* (2013.01); *B05B 1/18* (2013.01); *B05B 1/1654* (2013.01); *B05B 3/0422* (2013.01)

(58) Field of Classification Search

CPC ..... B05B 1/18; B05B 1/1636; B05B 1/1654; B05B 3/04; B05B 3/0427; B05B 1/185

USPC ..... 239/237, 240, 380–383, 443, 548, 556, 239/558–562, 565, 567

See application file for complete search history.

(56) References Cited

U.S. PATENT DOCUMENTS

| | | | | |
|---|---|---|---|---|
| 5,704,547 | A * | 1/1998 | Golan et al. | 239/11 |
| 6,732,950 | B2 * | 5/2004 | Ingham et al. | 239/205 |
| 2004/0164183 | A1 * | 8/2004 | Nobili | 239/449 |
| 2005/0263617 | A1 * | 12/2005 | Thong | 239/383 |
| 2006/0076436 | A1 * | 4/2006 | Zhadanov et al. | 239/383 |
| 2007/0205309 | A1 * | 9/2007 | Zhou | 239/587.1 |
| 2008/0156897 | A1 * | 7/2008 | Leber | 239/101 |
| 2010/0213289 | A1 * | 8/2010 | Huang | 239/587.1 |
| 2011/0024516 | A1 * | 2/2011 | Li et al. | 239/11 |

* cited by examiner

*Primary Examiner* — Len Tran
*Assistant Examiner* — Cody Lieuwen

(57) ABSTRACT

A rotary spray shower head includes a main body, a water distributing plate, a rear faceplate, an impeller, a pinion, a driven gear, a water outlet head assembly and a discharge faceplate. The present invention is simple in structure. When in use, one portion achieves an ordinary discharge function of the shower head, and another portion achieves a rotary discharge function. The present invention uses the pinion and the driven gear to constitute a planet deceleration. The rotating speed can be controlled, and the rotary spray discharge effect is good.

7 Claims, 8 Drawing Sheets

ROTARY SPRAY SHOWER HEAD

BACKGROUND OF THE INVENTION

1. Field of the Invention

The present invention relates to a spray shower head, and more particularly to a rotary spray shower head.

2. Description of the Prior Art

On the market, there are many different water discharge structures for a shower head to provide different discharge functions, such as shower water, massage water, mixed water and so on. However, the discharge positions of these functions are fixed. When taking a shower, the water is to wash some certain portions of the user. In particular, in the case of high water pressure, the current momentum is large, and the comfort of taking a shower is poor. The space between the water spouts are not directly washed by the water so the user needs more time and more water to take a shower.

In order to improve the existing water flow state, a shower head to discharge rotary water is developed accordingly, and there are many related patents, such as Chinese Patent No. 200520057606.5 disclosed a rotary shower head. But, the rotation range of each discharge nozzle of this shower head is too small so the area of the rotary water is small, not achieving the desired effect. This structure is only suitable for small nozzles of the shower head. If the number of the nozzles increases, the components of the shower head will increase, and the processing and assembly will be difficult and the cost will increase because each nozzle is an independent component. Chinese Patent No. 200420070842.6 discloses a shower head able to discharge rotary water. The impeller of this shower head directly turns a rotor for the outlets of the rotor to turn and discharge water. It is difficult to control the rotational speed. If the water pressure is too small, it is unable to drive the rotor. If the water pressure is too big, the speed is too high and the effect is not good. Chinese Patent No. 200910130251.0 discloses a shower head able to discharge rotary water. The impeller of this shower head directly turns a coaxial faceplate assembly to discharge water, without deceleration transmission. This shower head is only adapted for normal pressure, not for high water pressure and lower water pressure. Especially, when the water pressure is lower, it is difficult to rotate and discharge water. Accordingly, the inventor of the present invention has devoted himself based on his many years of practical experiences to solve these problems.

SUMMARY OF THE INVENTION

The primary object of the present invention is to provide a rotary spray shower head. The structure is simple, the rotating speed can be controlled, and the rotary spray discharge effect is good.

In order to achieve the aforesaid object, the rotary spray shower head of the present invention comprises a main body, a water distributing plate, a rear faceplate, an impeller, a pinion, a driven gear, a water outlet head assembly, and a discharge faceplate. The water distributing plate is sealingly assembled under the main body. The impeller is assembled under the water distributing plate through an eccentric shaft. The pinion is concentrically assembled under the impeller. The rear faceplate is sealingly assembled under the water distributing plate. A power room is formed between the water distributing plate and the rear faceplate for accommodating the impeller. Inclined openings are formed in the wall of the power room. Ordinary water holes are formed in the rear faceplate and the water distributing plate correspondingly. The discharge faceplate is sealingly assembled under the rear faceplate. A through hole is formed in the middle of the discharge faceplate. Ordinary discharge openings are formed in the periphery of the discharge faceplate. The driven gear is mounted between the rear faceplate and the discharge faceplate. Annular inner teeth of the driven gear mesh with the pinion. The water outlet head assembly is located in the through hole of the discharge faceplate. The water outlet head assembly comprises a hollow connecting stem, a water cavity and a water outlet. The hollow connecting stem sealingly passes through the through hole of the discharge faceplate to be fixed in a shaft hole of the driven gear.

Preferably, the water distributing plate is assembled under the main body through a screw, and a seal member is provided between the water distributing plate and the main body.

Preferably, the rear faceplate is welded under the water distributing plate, and the discharge faceplate is welded under the rear faceplate.

Preferably, the through hole of the discharge faceplate is formed with inner threads. Through the inner threads, a discharge fastening is assembled in the through hole. A seal member is provided between the discharge faceplate and the discharge fastening. The discharge fastening has a central through hole and an accommodation room formed at a lower end thereof. The water outlet head assembly is located in the accommodation room of the discharge fastening. The hollow connecting stem of the water outlet head assembly passes through the through hole of the discharge fastening to be fixed in the shaft hole of the driven gear through a seal member.

Preferably, the water outlet head assembly is composed of a rotary member, an upper lid and the hollow connecting stem. The bottom of the rotary member is formed with the water outlet. The hollow connecting stem is integrally formed on the upper lid. The upper lid is welded on top of the rotary member to form the water cavity.

Preferably, the water outlet head assembly is composed of a rotary member, an upper lid, the hollow connecting stem, a guide plate, a support and a meshed plate. The bottom of the rotary member is formed with the water outlet and an air outlet. The meshed plate, the support and the guide plate are assembled in sequence in the rotary member. The upper lid is welded on top of the rotary member to form the water cavity. The hollow connecting stem is integrally formed on the upper lid.

Preferably, the water outlet of the water outlet head assembly is inclined at an angle range of 2 to 15 degrees.

The present invention has a simple structure. When in use, the water in the main body flows to the water distributing plate to be distributed. One portion of the water flows out from the ordinary discharge openings through the ordinary water holes of the water distributing plate and the rear faceplate to achieve the ordinary discharge function of the spray shower head. Another portion of the water flows to the inclined openings to strike and turn the impeller. The impeller drives the driven gear through the pinion, and then the driven gear brings the water outlet head assembly to turn through the hollow connecting stem. In the meanwhile, the water flows through the power room where the impeller is located, and then flows to the water cavity of the water outlet head assembly through the hollow connecting stem at the shaft hole of the driven gear, and finally sprays out from the water outlet in a rotary manner. The present invention uses the pinion and the driven gear to constitute a planet deceleration. The rotating speed can be controlled, and the rotary spray discharge effect is good.

BRIEF DESCRIPTION OF THE DRAWINGS

FIG. 7-1 is another sectional view according to the first embodiment of the water outlet head assembly of the present invention;

FIG. 9-1 is another sectional view according to the second embodiment of the water outlet head assembly of the present invention.

DETAILED DESCRIPTION OF THE PREFERRED EMBODIMENTS

Figure 1:
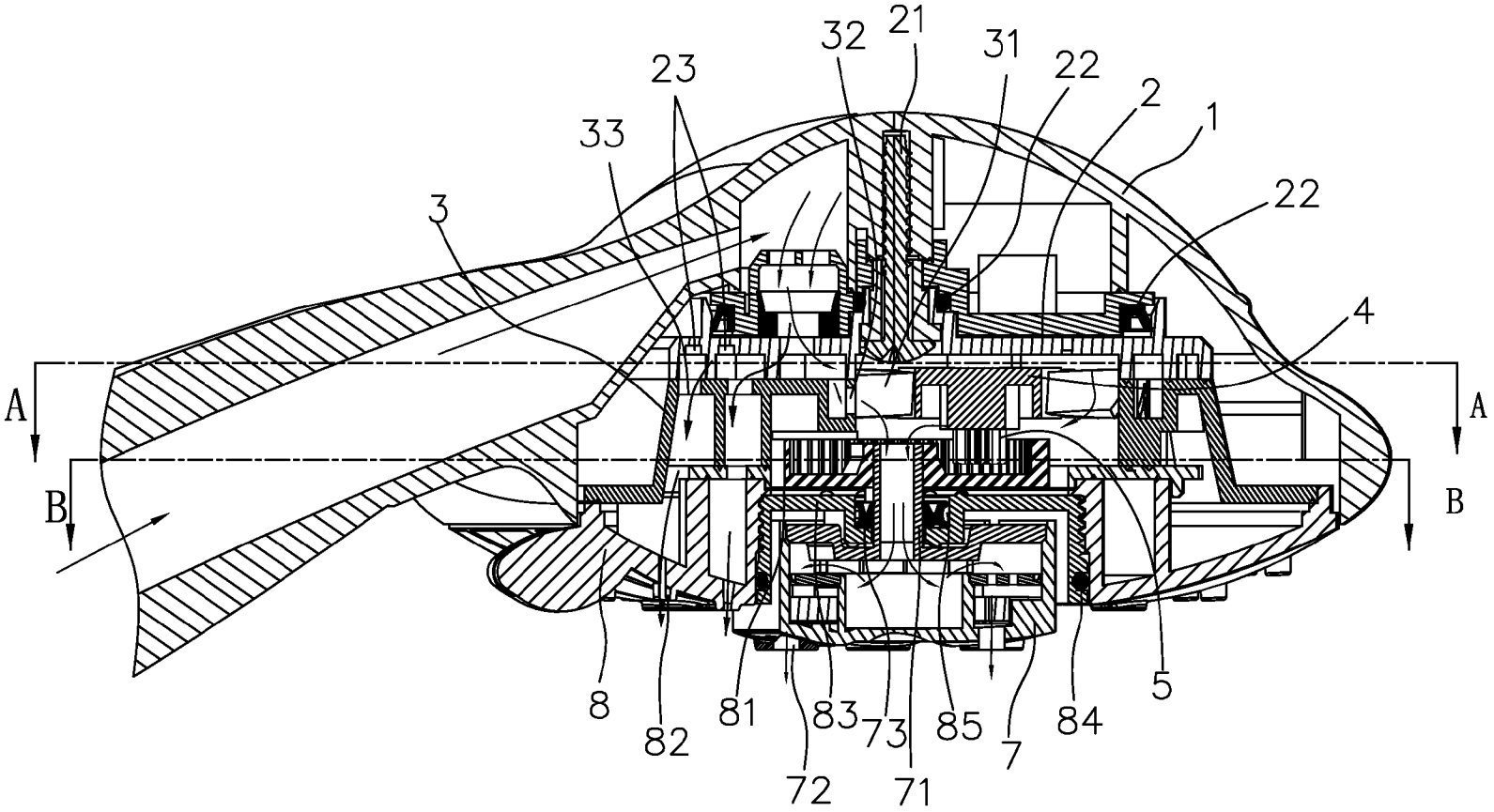
FIG. 1 is a sectional view according to a preferred embodiment of the present invention.
Figure 2:
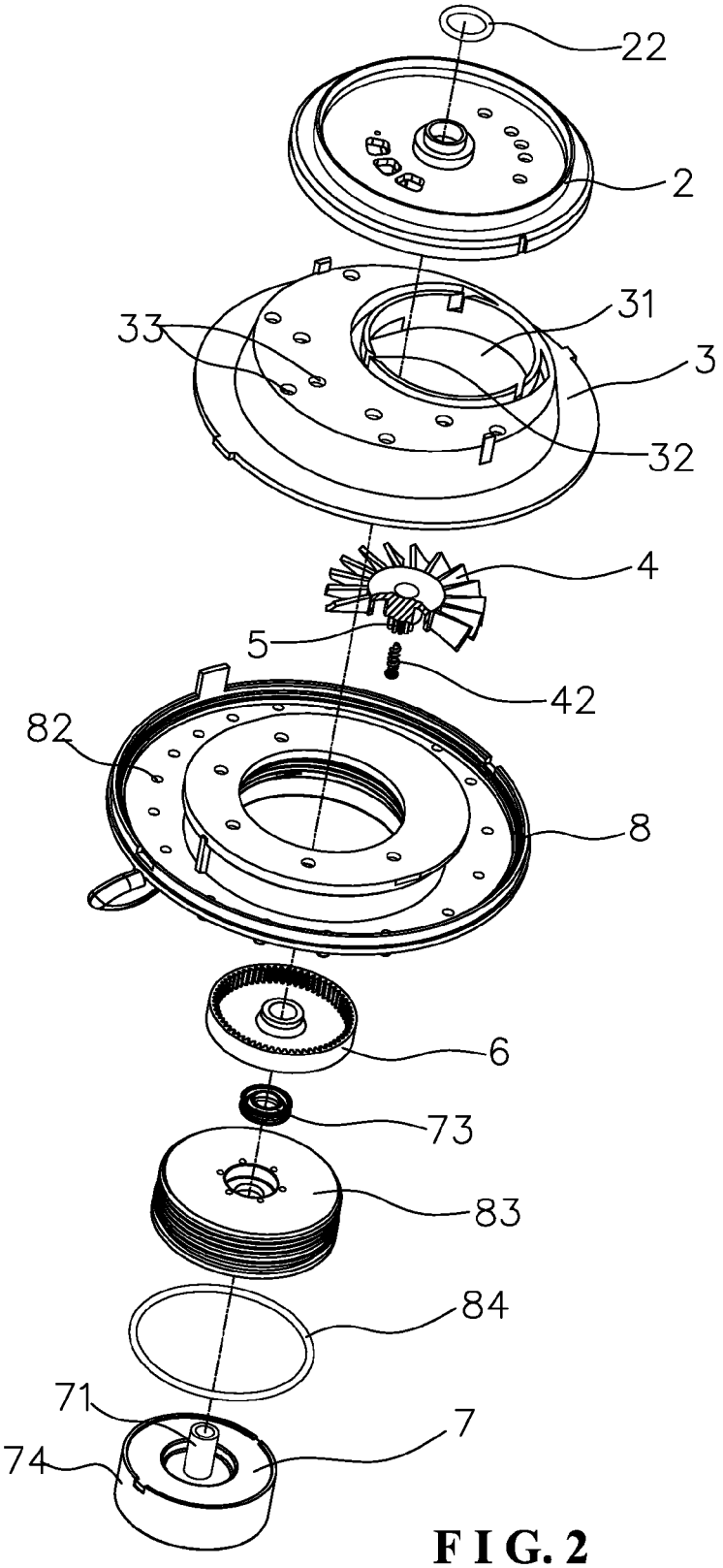
FIG. 2 is a top perspective view showing partial components of the present invention.
Figure 3:
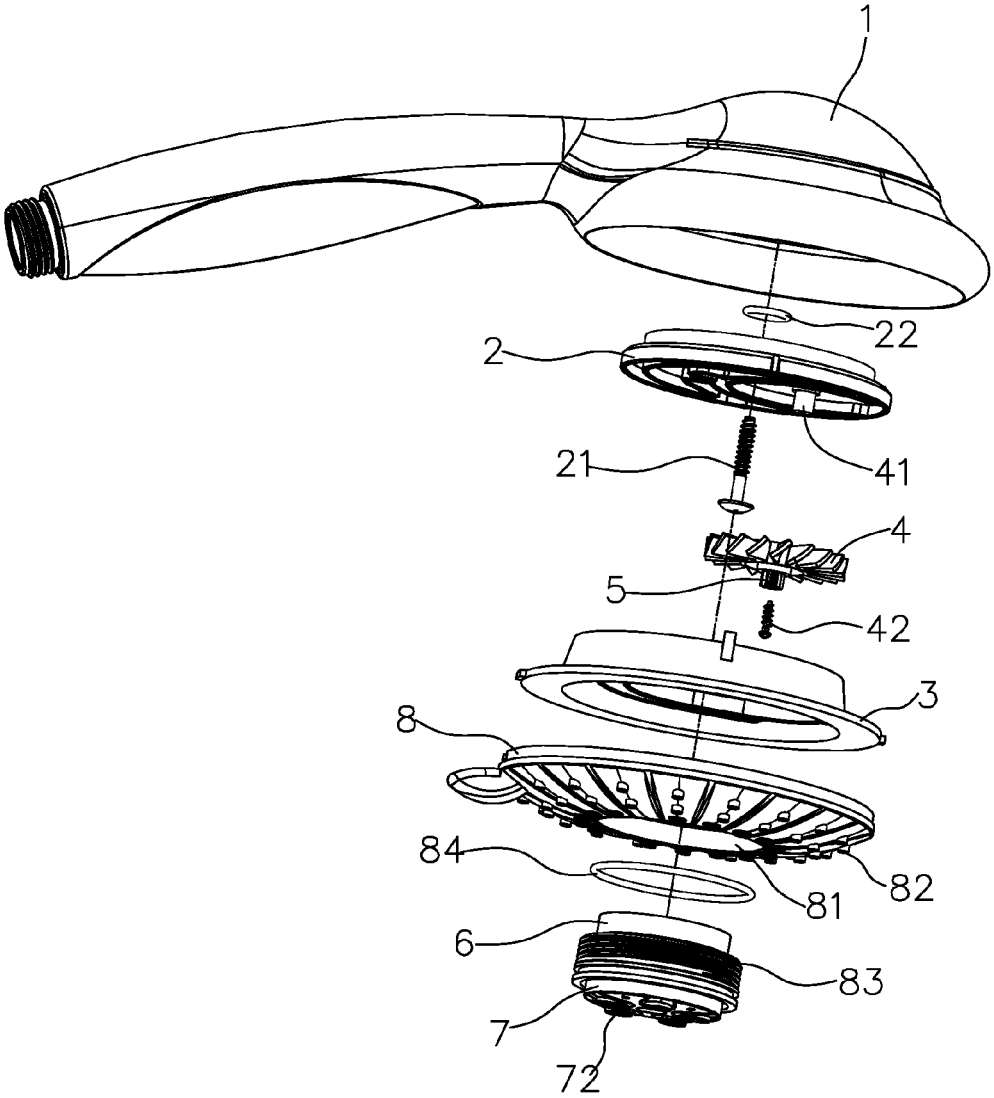
FIG. 3 is a bottom perspective view showing partial components of the present invention.
Figure 4:
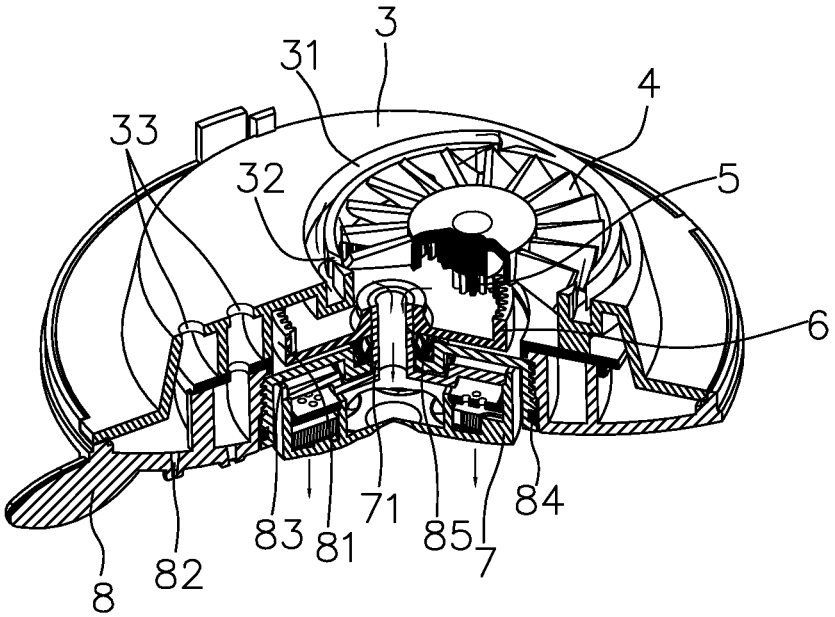
FIG. 4 is a sectional view taken along line A-A of FIG. 1.

Embodiments of the present invention will now be described, by way of example only, with reference to the accompanying drawings.

As shown in FIG. 1 to FIG. 5, the present invention discloses a rotary spray shower head which comprises a main body 1, a water distributing plate 2, a rear faceplate 3, an impeller 4, a pinion 5, a driven gear 6, a water outlet head assembly 7, and a discharge faceplate 8.

The water distributing plate 2 is assembled under the main body 1 through a screw 21. Two seal members 22's are provided between the water distributing plate 2 and the main body 1.

The impeller 4 is assembled under the water distributing plate 2 through an eccentric shaft 41 cooperating with a screw 42.

The pinion 5 is concentrically assembled under the impeller 4.

The rear faceplate 3 is welded under the water distributing plate 2. A power room 31 is formed between the water distributing plate 2 and the rear faceplate 3 for accommodating the impeller 4. Inclined openings 32 are formed in the wall of the power room 31. Ordinary water holes 33, 23 are formed in the rear faceplate 3 and the water distributing plate 2 correspondingly.

The discharge faceplate 8 is welded under the rear faceplate 3. A through hole 81 is formed in the middle of the discharge faceplate 8, and ordinary discharge openings 82 are formed in the periphery of the discharge faceplate 8.

The driven gear 6 is mounted between the rear faceplate 3 and the discharge faceplate 8. The annular inner teeth of the driven gear 6 mesh with the pinion 5.

Figure 5:
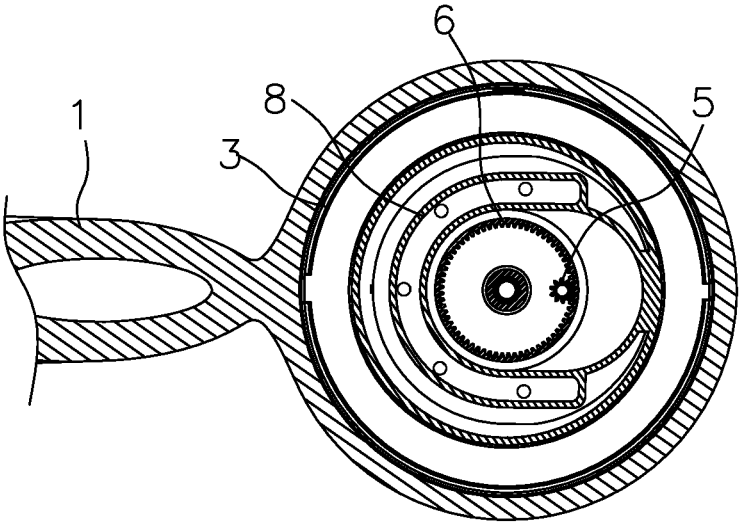
FIG. 5 is a sectional view taken along line B-B of FIG. 1.
Figure 6:
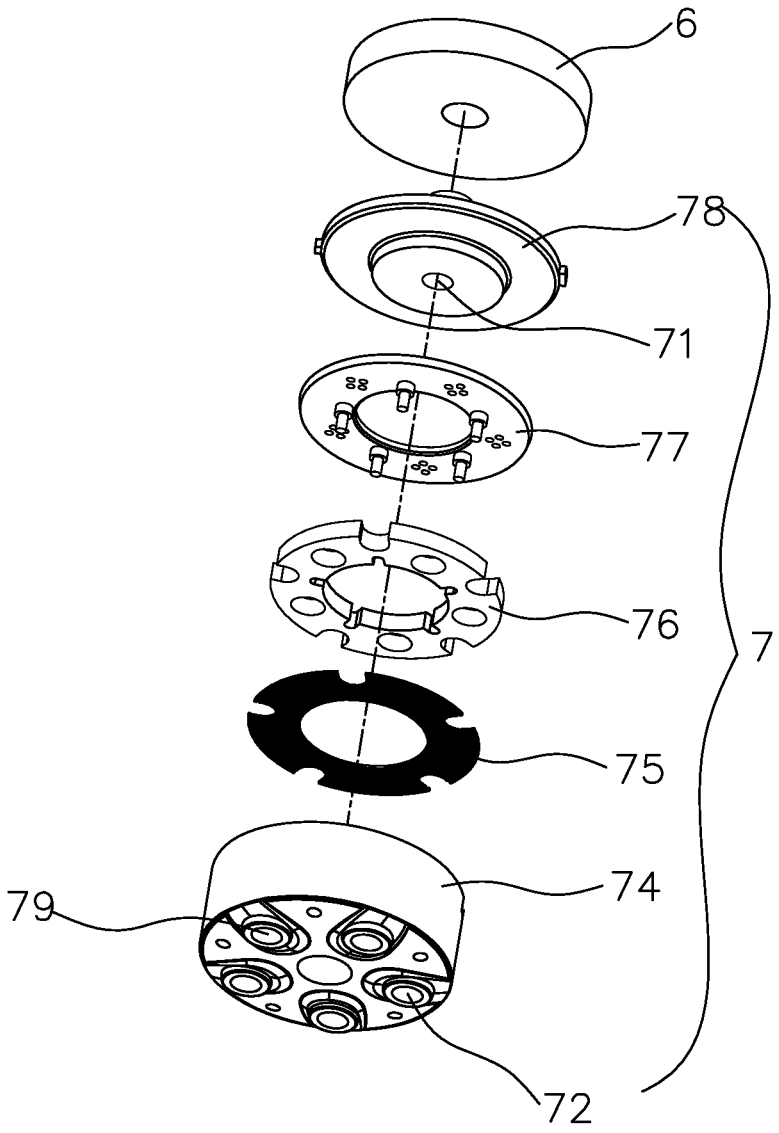
FIG. 6 is a perspective view according to a first embodiment of the water outlet head assembly of the present invention.
Figure 7:
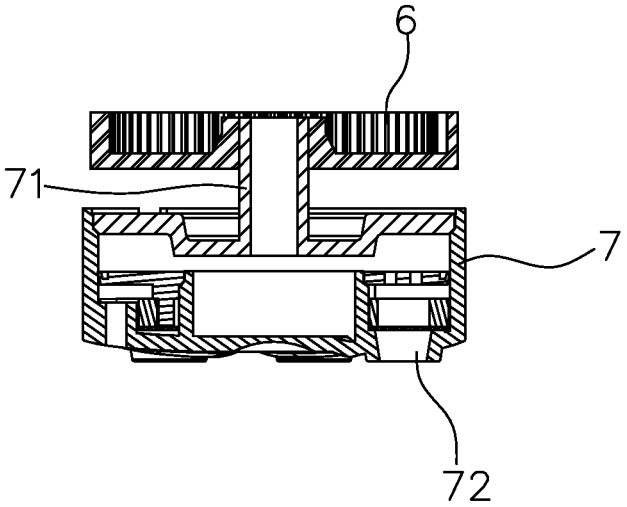
FIG. 7 is a sectional view according to the first embodiment of the water outlet head assembly of the present invention.
Figures 1, 7:
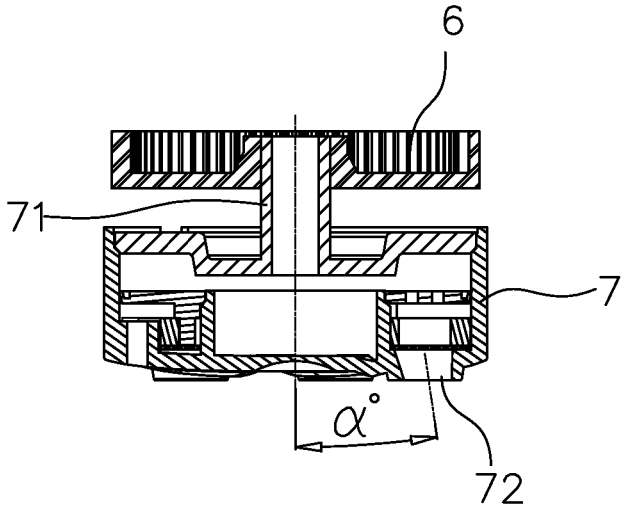
Figure 8:
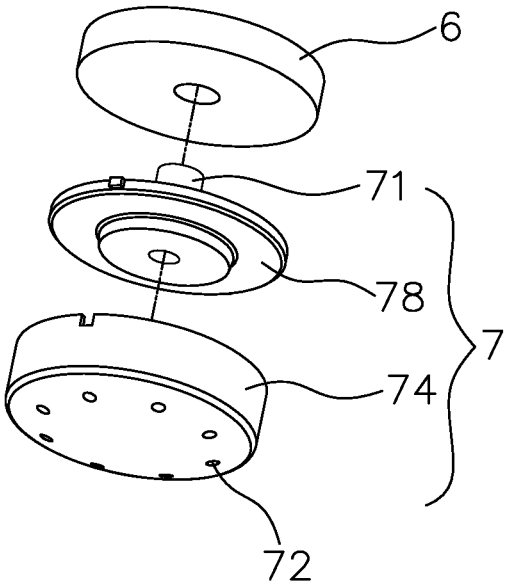
FIG. 8 is a perspective view according to a second embodiment of the water outlet head assembly of the present invention.
Figure 9:
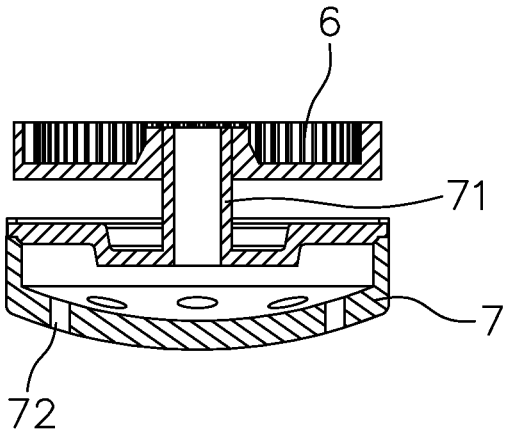
FIG. 9 is a sectional view according to the second embodiment of the water outlet head assembly of the present invention.
Figures 1, 9:
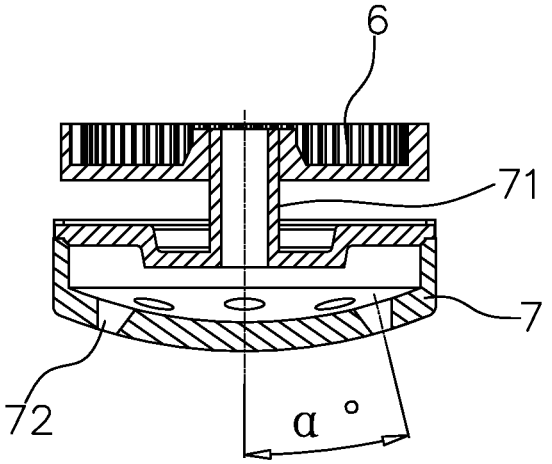

The water outlet head assembly 7 is located in the through hole 81 of the discharge faceplate 8. The water outlet head assembly 7 comprises a hollow connecting stem 71, a water cavity and a water outlet 72. The hollow connecting stem 71 passes through the through hole 81 of the discharge faceplate 8 to be fixed in a shaft hole of the driven gear 6 through a seal member. For convenient connection and assembly, in this embodiment the through hole 81 of the discharge faceplate 8 is larger and formed with inner threads. Through the inner threads, a discharge fastening 83 is assembled in the through hole 81. A seal member 84 is provided between the discharge faceplate 8 and the discharge fastening 83. The discharge fastening 83 has a central through hole 85 and an accommodation room formed at a lower end thereof to receive the water outlet head assembly 7. The hollow connecting stem 71 passes through the through hole 85 of the discharge fastening 83 to be fixed in the shaft hole of the driven gear 6 through a seal member 73. The water outlet head assembly 7 can be in different configurations. As shown in FIG. 8 and FIG. 9, the water outlet head assembly 7 is composed of a rotary member 74, an upper lid 78 and the hollow connecting stem 71. The bottom of the rotary member 74 is formed with the water outlet 72. The hollow connecting stem 71 is integrally formed on the upper lid 78. The upper lid 78 is welded on top of the rotary member 74 to form the water cavity. This water outlet head assembly 7 outputs cylindrical rotary water. As shown in FIG. 5 and FIG. 6, the water outlet head assembly 7 is composed of a rotary member 74, an upper lid 78, the hollow connecting stem 71, a guide plate 77, a support 76, and a meshed plate 75. The bottom of the rotary member 74 is formed with the water outlet 72 and an air outlet 79. The meshed plate 75, the support 76 and the guide plate 77 are assembled in sequence in the rotary member 74. The upper lid 78 is welded on top of the rotary member 74 to form the water cavity. The hollow connecting stem 71 is integrally formed on the upper lid 78. This water outlet head assembly 7 outputs the rotary water mixed with air. The water outlet 72 can be an upright hole as shown in FIG. 7 and FIG. 9 or an inclined hole as shown in FIG. 7-1 and FIG. 9-1. The angle of inclination is preferably at 2 to 15 degrees.

As shown by the arrow in the drawings, when in use, the water in the main body 1 flows to the water distributing plate 2 to be distributed. One portion of the water flows out from the ordinary discharge openings 82 through the ordinary water holes 23, 33 of the water distributing plate 2 and the rear faceplate 3 to achieve the ordinary discharge function of the spray shower head. Another portion of the water flows to the inclined openings 32 to strike and turn the impeller 4. The impeller 4 drives the driven gear 6 through the pinion 5, and then the driven gear 6 brings the water outlet head assembly 7 to turn through the hollow connecting stem 71. In the meanwhile, the water flows through the power room 31 where the impeller 4 is located, and then flows to the water cavity of the water outlet head assembly 7 through the hollow connecting stem 71 at the shaft hole of the driven gear 6, and finally sprays out from the water outlet 72 in a rotary manner.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A rotary spray shower head, comprising a main body, a water distributing plate, a rear faceplate, an impeller, a pinion, a driven gear, a water outlet head assembly and a discharge faceplate;

the water distributing plate, being assembled under the main body, with the main body having an opening on one side and a closing on an opposing side thereof;

the impeller, composed of blades disposed with an open space therebetween, being non-coaxially assembled under the water distributing plate through an eccentric shaft non-coaxially fixed beneath the water distributing plate;

the pinion being concentrically assembled under the impeller;

the rear faceplate, non-coaxially enveloping the impeller and the pinion inside a circular wall extending upwards parallel to a central axis of the rear faceplate under the water distributing plate, with a power room, being non-coaxially formed between the water distributing plate and the rear faceplate for accommodating the impeller;

inclined openings being formed in a wall of the power room extending upwards parallel to the central axis of the rear faceplate, ordinary water holes being formed in the rear faceplate and the water distributing plate correspondingly;

the discharge faceplate being sealingly assembled under the rear faceplate, a through hole being formed in a middle of the discharge faceplate, ordinary discharge openings being formed in a periphery of the discharge faceplate;

the driven gear being mounted between the rear faceplate and the discharge faceplate, annular inner teeth of the driven gear meshing with the pinion;

the water outlet head assembly being located in the through hole of the discharge faceplate, the water outlet head assembly comprising a hollow connecting stem, a water cavity and a water outlet, the hollow connecting stem sealingly passing through the through hole of the discharge faceplate to be fixed in a shaft hole of the driven gear.

2. The rotary spray shower head as claimed in claim 1, wherein the water distributing plate is assembled under the main body through a screw running from the water distributing plate into the main body, and a seal member is provided between the water distributing plate and the main body.

3. The rotary spray shower head as claimed in claim 1, wherein the rear faceplate is welded to form the power room to receive the impeller under the water distributing plate, and the discharge faceplate is welded with the through hole set in the middle of the discharge plate and ordinary discharge openings formed in the periphery thereof under the rear faceplate.

4. The rotary spray shower head as claimed in claim 1, wherein the through hole of the discharge faceplate is formed with inner threads, a discharge fastening being assembled in the through hole through the inner threads, a seal member being provided between the discharge faceplate and the discharge fastening, the discharge fastening having a central through hole and an accommodation room formed at a lower end thereof, the water outlet head assembly being located in the accommodation room of the discharge fastening, the hollow connecting stem of the water outlet head assembly passing through the through hole of the discharge fastening to be fixed in the shaft hole of the driven gear through a second seal member.

5. The rotary spray shower head as claimed in claim 1, wherein the water outlet head assembly is composed of a rotary member, an upper lid and the hollow connecting stem, a bottom of the rotary member being formed with the water outlet, the hollow connecting stem being integrally formed on the upper lid, and the upper lid being welded on top of the rotary member to form the water cavity.

6. The rotary spray shower head as claimed in claim 1, wherein the water outlet head assembly is composed of a rotary member, an upper lid, the hollow connecting stem, a guide plate, a support and a meshed plate, a bottom of the rotary member being formed with the water outlet and an air outlet, the meshed plate, the support and the guide plate being assembled in the rotary member, the upper lid being welded on top of the rotary member to form the water cavity, and the hollow connecting stem being integrally formed on the upper lid.

7. The rotary spray shower head as claimed in claim 5 or 6, wherein the water outlet of the water outlet head assembly is inclined at an angle range of 2 to 15 degrees with respect to a vertical axis with a general direction of the water outlet in a downward direction.

* * * * *